US006969307B2

(12) United States Patent
Kiermasz

(10) Patent No.: US 6,969,307 B2
(45) Date of Patent: Nov. 29, 2005

(54) POLISHING PAD CONDITIONING AND POLISHING LIQUID DISPERSAL SYSTEM

(75) Inventor: Adrian Kiermasz, Union City, CA (US)

(73) Assignee: Lam Research Corporation, Fremont, CA (US)

( * ) Notice: Subject to any disclaimer, the term of this patent is extended or adjusted under 35 U.S.C. 154(b) by 81 days.

(21) Appl. No.: 10/812,824

(22) Filed: Mar. 30, 2004

(65) Prior Publication Data

US 2005/0221730 A1 Oct. 6, 2005

(51) Int. Cl.[7] ..... B24B 1/00

(52) U.S. Cl. ..... 451/56; 451/10; 451/11; 451/36; 451/443; 451/446

(58) Field of Search ..... 451/56, 443, 10, 451/11, 41, 36, 285, 446

(56) References Cited

U.S. PATENT DOCUMENTS

| | | | | |
|---|---|---|---|---|
| 5,782,675 | A * | 7/1998 | Southwick | 451/56 |
| 5,857,899 | A | 1/1999 | Volodarsky et al. | 451/72 |
| 5,913,714 | A | 6/1999 | Volodarsky et al. | 451/41 |
| 6,053,801 | A * | 4/2000 | Pinson et al. | 451/56 |
| 6,086,460 | A | 7/2000 | Labunsky et al. | 451/56 |
| 6,190,236 | B1 * | 2/2001 | Drill | 451/41 |
| 6,200,207 | B1 * | 3/2001 | Hsu | 451/443 |
| 6,241,587 | B1 * | 6/2001 | Drill et al. | 451/56 |
| 6,283,840 | B1 * | 9/2001 | Huey | 451/288 |
| 6,306,019 | B1 | 10/2001 | Finkelman | 451/56 |
| 6,306,022 | B1 * | 10/2001 | Tung et al. | 451/290 |
| 6,328,637 | B1 | 12/2001 | Labunsky et al. | 451/56 |
| 6,336,845 | B1 | 1/2002 | Engdahl et al. | 451/41 |
| 6,361,414 | B1 | 3/2002 | Ravkin et al. | 451/56 |
| 6,371,838 | B1 * | 4/2002 | Holzapfel | 451/72 |
| 6,390,902 | B1 * | 5/2002 | Chang et al. | 451/285 |
| 6,530,827 | B2 * | 3/2003 | Mitsuhashi | 451/72 |
| 6,554,688 | B2 | 4/2003 | Lacy | 451/56 |
| 6,626,743 | B1 | 9/2003 | Boyd | 451/56 |
| 6,645,046 | B1 | 11/2003 | Vogtmann et al. | 451/8 |
| 6,648,740 | B2 * | 11/2003 | Perlov et al. | 451/288 |
| 6,695,684 | B2 * | 2/2004 | Park et al. | 451/56 |
| 6,740,169 | B2 * | 5/2004 | Cho et al. | 134/3 |
| 6,752,697 | B1 * | 6/2004 | Stoeckgen et al. | 451/56 |
| 6,773,332 | B2 * | 8/2004 | Moore | 451/5 |

* cited by examiner

*Primary Examiner*—Eileen P. Morgan
(74) *Attorney, Agent, or Firm*—Brinks Hofer Gilson & Lione

(57) ABSTRACT

A pad conditioning system for conditioning a polishing pad in conjunction with polishing of a workpiece includes a pad conditioning head coupled with a positioning unit. The pad conditioning head includes a conditioning surface that is configured to be moved into contact with a polishing pad to condition the polishing pad. The pad conditioning system also includes a polishing liquid supply port disposed in the conditioning surface. The polishing liquid supply port is configured to selectively discharge polishing liquid during the conditioning operation. The discharged polishing liquid is worked into the polishing pad by the pad conditioning head during the conditioning operation. A workpiece, such as a semiconductor wafer, that is also moved into contact with the polishing pad is polished using the discharged polishing liquid.

35 Claims, 5 Drawing Sheets

POLISHING PAD CONDITIONING AND POLISHING LIQUID DISPERSAL SYSTEM

FIELD OF THE INVENTION

The present invention relates to planarization of semiconductor wafers using a chemical mechanical planarization technique. More particularly, the present invention relates to a polishing pad conditioning system that is also a polishing liquid dispersal system used in conjunction with the polishing of a workpiece, such as a semiconductor wafer.

BACKGROUND

Semiconductor wafers are typically fabricated with multiple copies of a desired integrated circuit design that will later be separated and made into individual chips. Wafers are commonly constructed in layers, where a portion of a circuit is created on a layer and conductive vias are created to electrically connect the circuit to other layers. After each layer of the circuit is etched on the wafer, an oxide layer is put down allowing the vias to pass through but covering the rest of the previous circuit layer. Each layer of the circuit can create or add unevenness to the wafer that is typically smoothed before generating the next circuit layer.

Chemical mechanical planarization (CMP) techniques are used to planarize the raw wafer and each layer of material added thereafter. Available CMP systems are commonly called wafer polishers. Often such a wafer polisher will include a rotating wafer carrier head. The wafer carrier head may bring the wafer into contact with a polishing pad. In a rotary CMP system, the polishing pad may be circularly rotated in the plane of the wafer surface to be planarized. A polishing fluid, such as a chemical polishing agent or slurry containing micro abrasives may be applied to the polishing surface to polish the wafer. The wafer is pressed against the rotating polishing pad and is rotated to polish and planarize the wafer. Another CMP technique uses a linear polisher. Instead of a rotating pad, a moving belt is used to linearly move the pad across the rotating wafer surface.

As the wafer is polished, the polishing pad also becomes smoother or polished. The consistency in polishing multiple wafers is an important aspect of planarization of wafers. To maintain the surface of the polishing pad at a consistent level of abrasiveness, a pad conditioner may be used. The pad conditioner may similarly be pressed into the moving polishing pad. The surface of the pad conditioner may include an abrasive substance, such as diamond grit, to scratch or roughen the surface of the polishing pad. The surface of the polishing pad may be roughened to keep the polishing pad surface under substantially constant conditions, and therefore maintain similar removal rates with different semiconductors.

During the polishing process, slurry is typically dripped or otherwise discharged onto the moving polishing pad using a slurry distribution system. The slurry distribution system is typically upstream of where the wafer polishing occurs. The polishing pad may be porous, or non-porous, and may include grooves or other shapes formed in the polishing pad to assist in getting the dispersed slurry between the wafer and the moving polishing pad. In the case of a porous polishing pad, some of the slurry may soak into the polishing pad.

Since the polishing pad is moving, some of the slurry discharged onto the polishing pad does not adhere to the polishing pad and is thrown off. In addition, because the slurry is on the surface of the polishing pad and the wafer is pressed into the polishing pad, the slurry may not go between the wafer and the polishing pad as is desirable. Instead, the slurry may be pushed aside by the wafer similar to water being pushed aside by the bow of a boat. As a result, additional slurry may need to be discharged onto the polishing pad and additional slurry containment and capture mechanisms may be needed to capture the slurry that is discharged but not used in the polishing process. Slurry is expensive, and less than maximal use of the slurry may unnecessarily raise planarization processing costs.

The consistency of the rate of removal of material from the wafer may be adversely affected due to poor slurry distribution. For example, poor slurry distribution over the surface of the polishing pad may result in delamination (particularly copper with low k films), concentric removal rate profile variations across the wafer, etc. Accordingly, there is a need for systems and methods of maximizing and constantly maintaining the amount of slurry between the polishing pad and the wafer while minimizing the amount of slurry that is discharged, but is unused by the polishing process.

BRIEF SUMMARY

The present invention includes a pad conditioning system for conditioning a polishing pad in conjunction with polishing a workpiece. The pad conditioning system includes a pad conditioning head and a positioning unit. The pad conditioning head includes a conditioning element having a conditioning surface. The conditioning element also includes a passageway having an inlet and an outlet. The inlet is configured to receive a polishing liquid that is supplied through the passageway to the outlet. The outlet is at least one polishing liquid supply port that is formed in the conditioning surface.

The positioning unit may be configured to maneuver the pad conditioning head into contact with a polishing pad. In addition, the positioning unit may be configured to move the pad conditioning head around on the surface of the polishing pad in a determined pattern to condition, or roughen, the surface of the polishing pad. The determined pattern may correspond to the areas of the polishing pad being used to planarize a workpiece.

The pad conditioning head is configured to be pressed into the polishing pad so that the conditioning surface is in contact with and is conditioning the polishing pad. Polishing liquid may be supplied to the inlet of the polishing element and be discharged from the port. Accordingly, the pad conditioning head is capable of conditioning the polishing pad and simultaneously working the discharged polishing liquid into the roughened polishing pad.

The polishing liquid may be massaged into the polishing pad by the conditioning surface and become embedded. The polishing liquid may become embedded in the features that are formed and/or embellished when the polishing pad is conditioned with the conditioning surface. In other words, the polishing liquid may be forced or encouraged into the features, such as a roughened surface, grooves and/or channels during the conditioning operation. In addition, the polishing liquid may be forced or encouraged into the pores of a polishing pad formed with a porous material. Since the polishing liquid is worked into the polishing pad, the amount of polishing liquid between a workpiece and the polishing pad during planarization is maximized. In addition, the embedded polishing liquid is less likely to be thrown off of the moving polishing pad.

The polishing liquid may also be uniformly distributed over the polishing pad. As the pad conditioning head is maneuvered on the polishing pad, the flow rate of polishing liquid discharged from the port may be dynamically varied. The flow rate may be varied based on the position of the pad conditioning head on the polishing pad and/or other process parameters associated with planarization of a workpiece. Accordingly, the amount of polishing liquid between the workpiece and the polishing pad may be consistently maximized while minimizing the amount of polishing liquid that is applied to the polishing pad and goes unused.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF SEVERAL VIEWS OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

The present invention includes a polishing pad conditioning system. The polishing pad conditioning system may maintain the condition of a surface of a polishing pad during polishing of a workpiece. During the polishing process, a number of workpieces, such as semiconductors, may be sequentially polished with the polishing pad. Each of the workpieces is pressed into the moving polishing pad to planarize the surface of the workpiece. The pad conditioning system is used to condition the polishing pad to sustain a surface of the polishing pad in a relatively constant state. In addition, the pad conditioning system introduces a polishing liquid to the polishing pad. The polishing liquid may be discharged from the pad conditioning system during conditioning of the polishing pad, and is used in planarization of the workpiece.

Figure 1:
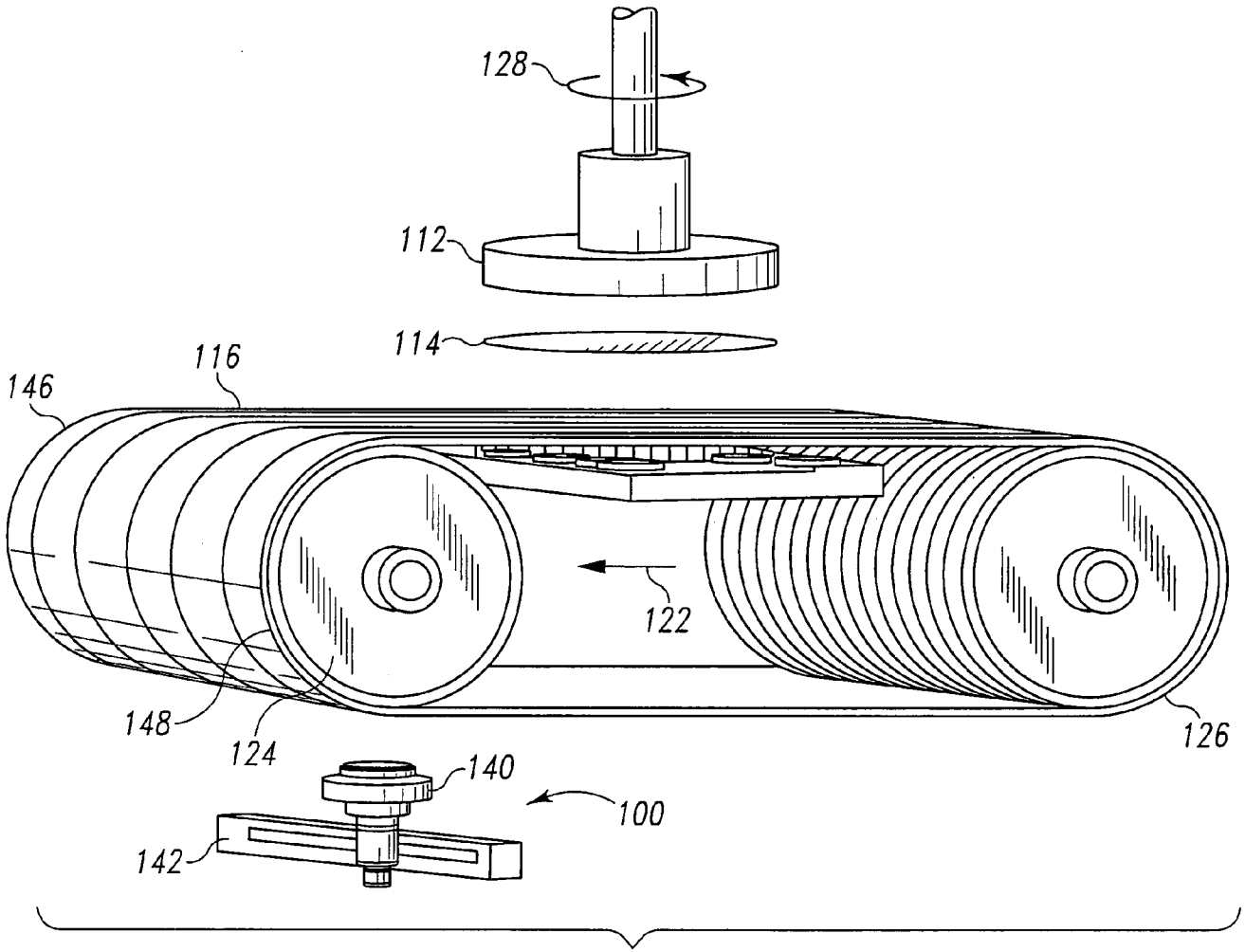
FIG. 1 is a front view of a chemical mechanical planarization machine.

FIG. 1 is a perspective view of an example chemical mechanical planarization (CMP) machine that includes a pad conditioning system 100. The illustrated CMP machine is a semiconductor wafer polishing machine. The semiconductor wafer polishing machine may be used in interlayer dielectric (ILD) processing, intermetallic dielectric (IMD) processing, pre-metal dielectric (PMD) processing, copper (Cu) processing or any other form of planarization processes for semiconductor wafers. Other objects such as, for example, quartz crystals, ceramic elements, lenses, glass plates and other work pieces may also be planarized and/or polished by the CMP machine. The example CMP machine uses linear planarization technology and may be part of a TERES™ Chemical Mechanical Planarization (CMP) system available from Lam Research Corporation located in Fremont, Calif. In other examples any other form of chemical mechanical planarization (CMP) such as rotary, orbital, etc. may be used with the pad conditioning system 100.

The example CMP machine also includes a wafer carrier 112 that may have a semiconductor wafer 114 detachably coupled with the wafer carrier 112 by a vacuum or other similar mechanism. The wafer carrier 112 may be maneuvered to place the semiconductor wafer 114 in pressurized contact with a polishing pad 116 as indicated by arrow 120. In the illustrated example, the polishing pad 116 is a belt. In other examples of CMP machines, other forms of polishing pads, such as a rotary polishing pad or a stationary polishing pad may be employed.

The polishing pad 116 may be formed with a porous or a non-porous material. In addition, the polishing pad 116 may be formed to be abrasive or non-abrasive. An example abrasive polishing pad 116 may be formed with abrasive particles embedded in a polymer matrix. An example non-abrasive polishing pad 116 may be formed with synthetic polymers such as polyurethane, extended fibers, and felt impregnated with a polymer. The hardness of the polishing pad 116 may also be varied.

The illustrated polishing pad 116 represents an endless polishing surface that is operable to move horizontally in the direction indicated by arrow 122. The polishing pad 116 may be wrapped around a first roller 124 and a second roller 126. The first or second roller 124 or 126 may be rotated with a roller motor (not shown) at a determined speed.

During polishing, the first and second rollers 124 and 126 may rotate to move the polishing pad 116 linearly against the semiconductor wafer 114 while the wafer carrier 112 may also be rotated as illustrated by arrow 128. The semiconductor wafer 114 may be pressed into the surface of the rotating polishing pad 116, while the polishing pad 116 may be supported opposite the semiconductor wafer 114 by a backing support (not shown), such as an air bearing generated with a platen. In other examples, any other form of structure or device, such as a roller, a smooth supported surface, etc. may be used for the backing support.

The pad conditioning system 100 may be positioned adjacent to the wafer carrier 112, and be selectively brought into contact with the surface of the polishing pad 116. The illustrated pad conditioning system 100 is positioned adjacent the surface of the polishing pad 116 on the side opposite the wafer carrier 112 at the bottom of the first roller 124. In another example, the pad conditioning system 100 may be positioned below the second roller 126 adjacent the surface of the polishing pad 116. In still other examples, the conditioning system 100 may be positioned anywhere else adjacent to the surface of the polishing pad 116. If the pad conditioning system 100 is positioned to contact the surface of the polishing pad 116 where the polishing pad 116 is unsupported, a backing support may be used.

The pad conditioning system 100 includes a pad conditioning head 140 coupled with a positioning unit 142. The positioning unit 142 may be a lineal device and/or a radial device that include hinges, servo motors, hydraulics or any other mechanism(s) that enables lateral, vertical and/or rotational movement of the pad conditioning head 140.

During operation, the pad conditioning head 140 may be moved into contact with the surface of the rotating polishing pad 116. A determined amount of down force may be applied by the positioning unit 142 to the pad conditioning head 140 to condition (or roughen) the polishing pad 116. As used herein, the terms "condition", "conditioning" or "conditioned" refers to the result of physical contact between the pad conditioning head 140 and the polishing pad 116 that leaves the polishing pad 116 scratched, abraded or otherwise substantially uniformly roughened.

The positioning unit 142 may move the pad conditioning head 140 in a predetermined pattern on the surface of the polishing pad 116. The predetermined pattern may enable the entire surface of the polishing pad 116 to be continuously and uniformly conditioned. For example, the positioning unit 142 may be a lineal device that selectively moves the pad conditioning head 140 perpendicularly to the rotation of the polishing pad 116 between a first edge 146 and a second edge 148 of the polishing pad 116. Movement of the pad conditioning head 140 may also track and/or take into consideration those areas of the polishing pad 116 where a work piece is being polished. For example, the pad conditioning head 140 may move more slowly, or otherwise perform additional conditioning in areas of the polishing pad 116 that are more heavily used during the polishing operation.

The positioning unit 142 may also rotate the pad conditioning head 140. Rotation and/or movement of the pad conditioning head 140 may be performed to minimize inconsistencies in conditioning of the polishing pad 116. In addition, the movement of the polishing pad 116 may allow conditioning of the part of the polishing pad 116 that is used to polish the workpiece.

The pad conditioning head 140 may also be configured to add a polishing liquid to the polishing pad 116. The polishing liquid may be a chemical polishing agent, a slurry containing microabrasives and/or any other liquid (or liquid with suspended solids) that can be used in connection with polishing and/or grinding of solid surfaces, such as a semiconductor wafer 114. The polishing liquid may be discharged by the pad conditioning head 140 between the pad conditioning head 140 and the polishing pad 116.

Features such as micro channels, inequalities, unevenness, ridges, valleys and/or projections in the surface of the polishing pad 116 may be formed and/or embellished during conditioning by the pad conditioning head 140. Features in the polishing pad 116 may also include grooves and/or channels that have been embossed, molded and/or cut into the polishing pad 116. Using the pad conditioning head 140, the polishing liquid may be massaged or otherwise worked into these features within the polishing pad 116 during conditioning. In addition, when the polishing pad 116 is porous, or is otherwise permeable to fluids, the polishing liquid may be worked into the pores of the polishing pad 116. As such, the polishing liquid may be encouraged and/or forced into the features of the polishing pad 116 at the same time a conditioning operation is being performed.

Since the polishing liquid is kneaded, or pressed, into the pores and/or features of the polishing pad 116, the polishing liquid is much less likely to be liberated from the polishing pad 116 as a result of the movement of the polishing pad 116. In addition, the polishing liquid is worked into the pores and/or features of the polishing pad 116, and is therefore less likely to be pushed aside by the wafer 114 being pressed into the polishing pad 116. Accordingly, the amount of polishing liquid between the polishing pad 116 and the pad conditioning head 140 may be maximized.

The motion of the pad conditioning head 140 to perform conditioning also provides for the allocation of the polishing liquid over the entire surface of the polishing pad 116. Distribution of the polishing liquid on/in the polishing pad 116 is localized and the flow rate may be controlled to provide uniformity of the allocation of the polishing liquid over the entire area of the polishing pad 116. In addition, a higher flow of polishing liquid may be discharged in areas of the polishing pad 116 experiencing heavier usage that may also receive more pad conditioning. The flow of polishing liquid may be regulated to provide a zonal effect on the polishing pad 116 resulting in an even layer of polishing liquid. As a consequence of the even layer of polishing liquid, consistency in the polishing and/or planarization of the semiconductor wafers 114 may be maximized.

Figure 2:
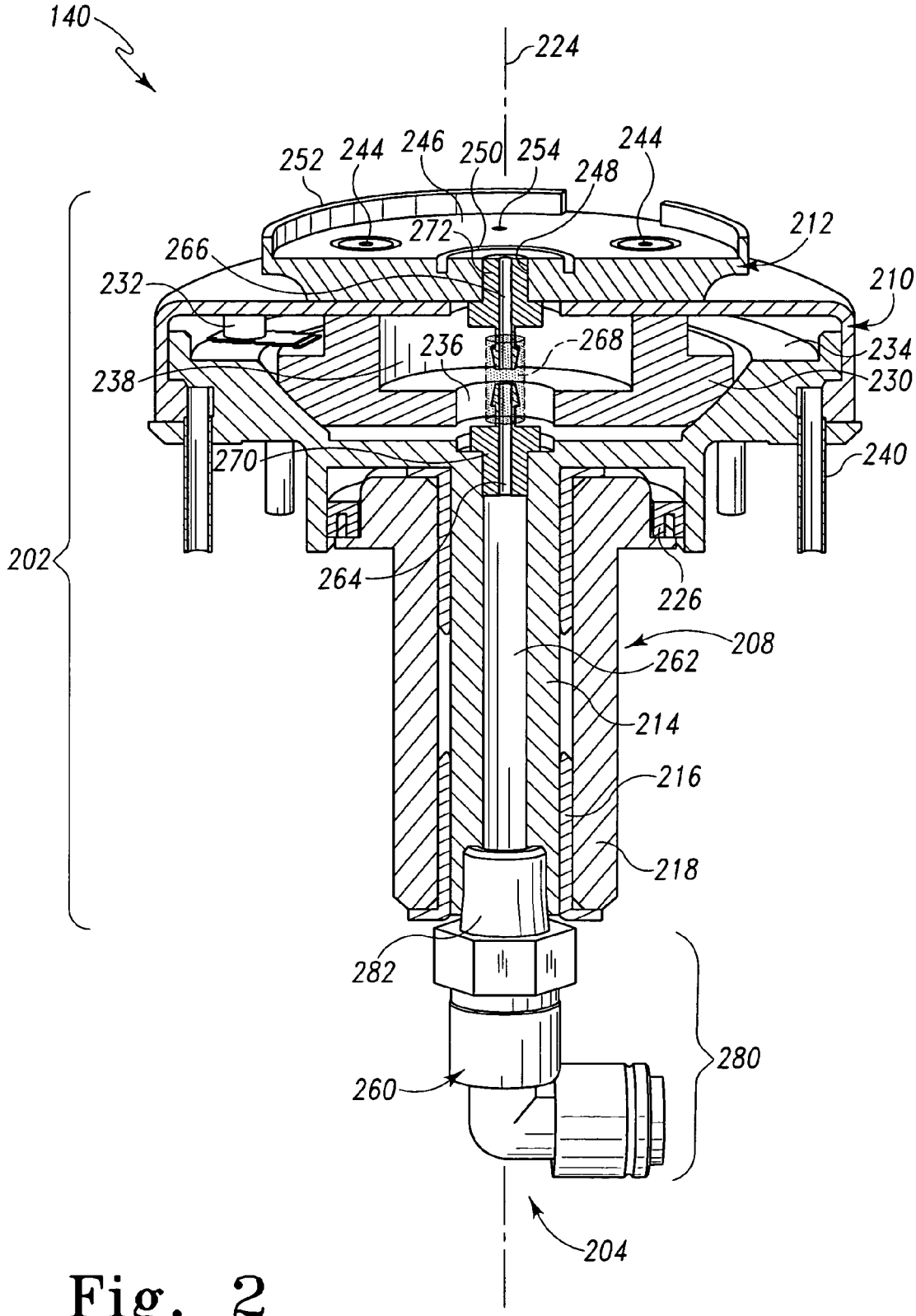
FIG. 2 is a cross section of an example of the pad conditioning head illustrated in FIG. 1.

FIG. 2 is a perspective partial cross-sectional view of an example pad conditioning head 140. The pad conditioning head 140 includes a housing 202 and a polishing liquid supply line 204. As previously discussed, the example pad conditioning head 140 is configured to be mounted below the polishing pad 116 (FIG. 1). The polishing liquid supply line 204 may be configured to extend through the pad conditioning head 140 as illustrated. Alternatively, the polishing liquid supply line 204 may be routed external to the pad conditioning head 140. In other examples, other mounting positions and/or hardware configurations may be used to provide similar functionality.

The illustrated housing 202 includes a neck 208, a chamber 210 and a mounting plate 212. The neck 208 may include a spindle 214 formed to accommodate the polishing liquid supply line 204 extending therethrough. In addition, the neck 208 may include a sleeve bearing 216 and a stationary housing 218. In the illustrated example, one end of the spindle 214 may be coupled with, and rotated by, the positioning unit 142 (FIG. 1). The other end of the spindle 214 may be coupled with the chamber 210 to rotate the chamber 210 and the mounting plate 212. The spindle 214 may be rotated concentric with a central axis 224 of the pad conditioning head 140.

The spindle 214 may be formed of plastic, steel or any other rigid material capable of being rotated. The sleeve bearing 216 is positioned to surround the spindle 214 to reduce frictional rotation between the rotating spindle 214 and the stationary housing 218. The sleeve bearing 216 may be stationary during rotation of the spindle 214 and may be formed with a low friction material such as plastic. The stationary housing 218 may be non-rotatably coupled with the positioning unit 142 (FIG. 1) by fasteners, threads or some with coupling mechanism. In other examples, the spindle 214 may be non-rotatable and/or reciprocating.

The neck 208 also includes a gasket 226. The gasket 226 is positioned between the chamber 210 and a portion of the stationary housing 218 and may be formed of rubber, or some other flexible material. The illustrated gasket 226 may be formed in a u-ring to provide a seal between the stationary housing 218 and the rotatable chamber 210. In addition, the gasket 226 may act as a friction-causing member. In other examples, the gasket 226 may be an O-ring or any other form of gasketing material.

The legs of the u-ring shaped gasket 226 may push outward with enough force to provide a seal and still allow for rotation of the chamber 210 with respect to the stationary housing 218. Alternatively, the legs of the gasket 226 may push outward to create sufficient friction to stop rotation of the spindle 214 and chamber 210 during conditioning of the polishing pad 116 (FIG. 1). In this example, the friction created by the legs of the gasket 226 may still allow rotation of the spindle 214 and chamber 210 during other operational conditions such as when the pad conditioning head 140 is not conditioning the polishing pad 116 and is placed in a parked or home position.

The chamber 210 may be formed with a flexible, durable, strong rubber-like material. The chamber 210 enables the mounting plate 212 to be self-centering relative to the remainder of the pad conditioning housing 202. In addition, the flexible material of the chamber 210 prevents the mounting plate 212 from moving too far in any one direction. The illustrated chamber 210 includes a gimbal bearing 230 and a load cell 232. The gimbal bearing 230 and the load cell 232 may be disposed in a cavity 234 formed by the chamber 210.

The gimbal bearing 230 may be fixedly coupled with the spindle 214 and the mounting plate 212 through the chamber 210. The gimbal bearing 230 may be formed of a bearing grade plastic, such as ERTALYTE PET-P, PEEK bearing grade, TEFLON, TURCITE A&X, RULON LR, TORLON 4301, etc. The mounting plate 212 may be allowed to gimble with respect to the spindle 214 due to the gimbal bearing 230 and the flexibility of the chamber 210. A gimble point for the mounting plate 212 may be located above the mounting plate 212 external to the pad conditioning head 140. Gimbling of the mounting plate 212 with respect to the gimble point may maintain an upper surface 246 of the mounting plate 212 substantially parallel with respect to the polishing pad 116 (FIG. 1) during a conditioning operation.

The gimble bearing 230 includes a passageway 236 formed to accommodate the polishing liquid supply line 204. The passageway 236 may be formed to be large enough so that the polishing liquid supply line 204 does not bind or kink as the mounting plate 212 is allowed to gimble. In addition, the gimble bearing 230 includes a gimble cavity 238. The gimble cavity 238 is formed to accommodate hardware associated with the polishing liquid supply line 204 as described later.

The load cell 232 may be any mechanism or device capable of providing an electrical signal indicative of an amount of down force (or deflection) applied to the pad conditioning head 140. More specifically, the gimbal bearing 230 may transfer a downward force to the mounting plate 212 that is applied to the spindle 214 by the positioning unit 142 (FIG. 1). During the conditioning operation, when a down force is applied, the gimbal bearing 230 may move toward the polishing pad 116, while the chamber 210 remains substantially stationary and flexes in response to the down force. The load cell 232 may be calibrated based on the flexibility of the chamber 210 to provide indication of the amount of down force applied.

The chamber 210 may also include a plurality of rotation pins 240. The rotation pins 240 may be dowels or other similar structures that are spaced around the outside of the chamber 210 to guide the circular rotation of the pad conditioning head 140. For example, when the pad conditioning head 140 is away from the polishing pad 116 (FIG. 1), such as in a home or other parked position, the rotation pins 240 may cooperatively operate with a stationary ratchet member (not shown) to guide rotation of the spindle 214 and mounting plate 212.

The mounting plate 212 can be formed of any rigid material such as stainless steel. The illustrated mounting plate 212 is coupled through the chamber 210 with the gimbal bearing 230 by fasteners 244 that are flat head screws. The fasteners 244 penetrate the surface 246 of the mounting plate 212 through apertures in the upper surface 246. In other examples, welding, gluing or any other type of fasteners may be used. The mounting plate 212 also includes at least one polishing liquid supply aperture 248 that penetrates through the upper surface 246 of the mounting plate 212. The polishing liquid supply aperture 248 may be formed concentric with the central axis 224 to accommodate a portion of the polishing liquid supply line 204. Alternatively, a plurality of polishing liquid supply apertures 248 may be formed in the mounting plate 212 to accommodate a plurality of polishing liquid supply lines 204.

Also formed in the mounting plate 212 is a groove 250, a collar 252 and a mounting aperture 254. The groove 250 may be concentric with the central axis 224 and formed in the upper surface 246. The collar 252 may concentrically surround and extend perpendicular to the upper surface 246. The mounting aperture 254 may be a threaded aperture formed in the upper surface 246 with a determined depth. The upper surface 246, the groove 250 and the collar 252 may be formed to accommodate a conditioning element.

Figure 3:
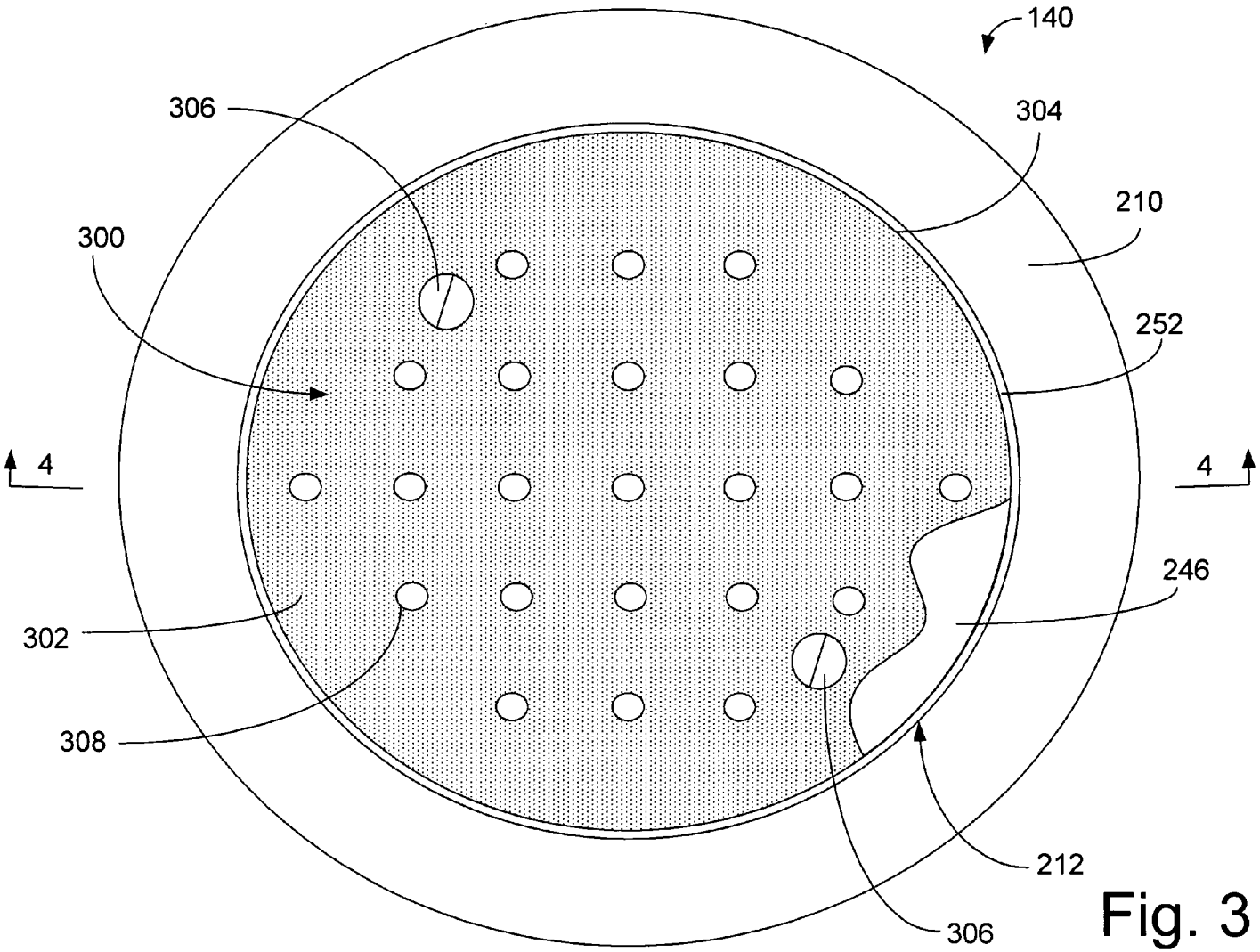
FIG. 3 is a top view of the pad conditioning head illustrated in FIG. 2 with a partially sectioned conditioning element included.

FIG. 3 is a top partial cut-away view of the pad conditioning head 140. The pad conditioning head 140 includes an example conditioning element 300 mounted on the mounting plate 212 above the chamber 210. The conditioning element 300 may be a circular shaped disc, a crescent shape plate, a spherical shaped object or any other shape and/or object capable of being brought into contact with a polishing pad 116 (FIG. 1). In the illustrated example, the conditioning element 300 is a circular disc of a predetermined diameter, such as about two inches that is formed to be mounted on the upper surface 246 of the mounting plate 212. An outer edge 304 of the conditioning element 300 may be positioned adjacent to the collar 252 to maintain the conditioning element 300 concentrically mounted on the mounting plate 212.

The conditioning element 300 may be formed of stainless steel or other similar rigid material and includes a first surface that is a conditioning surface 302 formed to be pressed into the polishing pad 116 (FIG. 1). An abrasive substance may be adhered to the conditioning surface 302. The abrasive substance may be formed on the surface 302 by brazing particles, such as diamonds, to the conditioning surface 302 and then coating the particles with a finish coat. The finish coat may be any material capable of sealing the particles, such as physical vapor deposition (PVD), chemical vapor deposition (CVD) or some other process of laying down a coating. The conditioning surface 302 is brought into contact with the polishing pad 116 (FIG. 1) so that the abrasive surface is enabled to scratch the polishing pad 116 (FIG. 1). In one example, the conditioning surface 302 is substantially flat, and the abrasive surface may include particles that extend above the conditioning surface 302. In another example, the surface 302 may be dome shaped with the abrasive particles 304 extending outwardly from the hemispherical shaped surface 302.

At least one mounting aperture 306 may be formed in the conditioning surface 302 of the conditioning element 300. The mounting aperture 306 may be formed to accommodate a fastener such as a threaded flat head screw as illustrated. The fastener may penetrate through the conditioning element 300 and be coupled with the mounting aperture 254 (FIG. 2) in the upper surface 246 of the mounting plate 212. Thus, the conditioning element 300 may be securely coupled with the mounting plate 212. Alternatively, or in addition, the mounting plate 212 may be formed of a material capable of maintaining a magnetic charge and the conditioning element 300 may be attractive to a magnetic charge. Any one or more of the described coupling mechanisms may be employed to detachable couple the conditioning element 300 to the mounting plate 212. Since the conditioning element 300 is rigidly mounted on the mounting plate 212, the conditioning element 300 may gimbal with the mounting plate 212 so that the surface 302 remains substantially parallel with the polishing pad 116 (FIG. 1) during a conditioning operation.

The conditioning element 300 also includes a plurality of outlets that are polishing liquid distribution ports 308. The ports 308 may be arranged in any desired pattern over the conditioning surface 302. Alternatively, channels, slits, grooves or any other form of outlet may be formed in the conditioning surface 302. In still other examples, a single port 308, a plurality of ports 308 in determined positions and/or some combination of ports and/or other forms of outlet(s) may be formed in the conditioning surface 302. In still other examples, the ports 308 may be formed and/or coupled as nozzles around the peripheral edge of the conditioning element 300. In this example, the polishing liquid may be discharged onto the polishing pad 116 so that the moving pad conditioning head 140 moves over top of the discharged polishing liquid. Accordingly, the polishing liquid is still discharged to be between the polishing pad 116 and the pad conditioning head 142.

Figure 4:
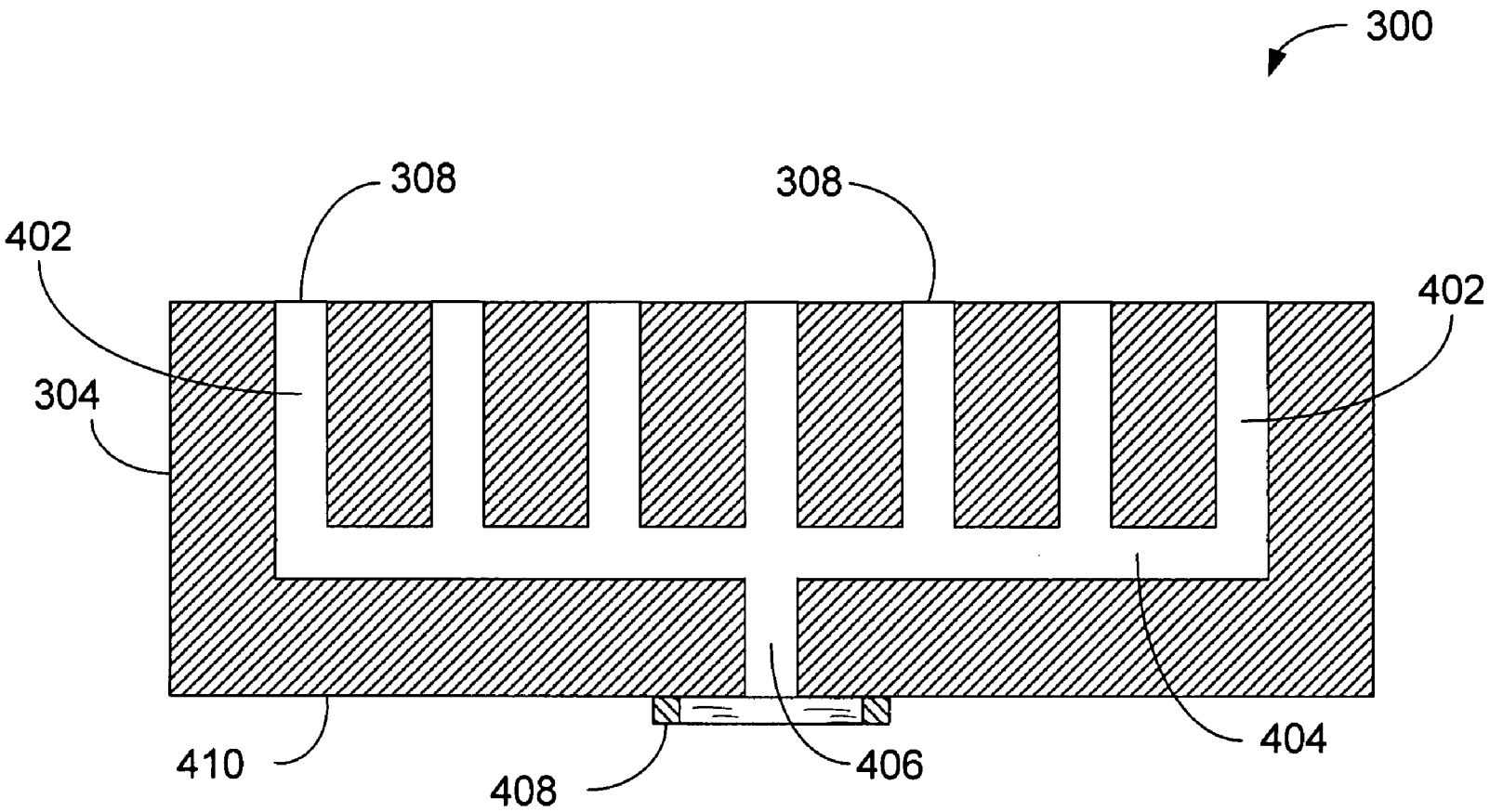
FIG. 4 is a cross section of the conditioning element illustrated in FIG. 3.

FIG. 4 is a cross-sectional side view of the example conditioning element 300 illustrated in FIG. 3 taken along line 4—4. The illustrated conditioning element 300 includes the ports 308 arranged on the conditioning surface 302. Each of the ports 308 form an outlet for a passageway 400 formed in the conditioning element 300. The passageway 400 includes a plurality of polishing liquid discharge passageways 402 for each of the corresponding ports 308. Each of the discharge passageways 402 are in liquid communication with a polishing liquid distribution manifold 404 that is also included as part of the passageway 400. The distribution manifold 404 is coupled with an inlet 406 to the passageway 400. The inlet 406 is configured to receive a flow of polishing liquid. The polishing liquid may enter the inlet 406 under pressure, be distributed by the distribution manifold 404 to the discharge passageways 404, and be discharged from the ports 308.

In an alternative example, the conditioning element 300 may include a plurality of inlets 406. Each of the inlets 406 may be in liquid communication with one or more discharge passageways 402. In this configuration, pressurized polishing liquid may be selectively introduced to the inlets 406 and be discharged from corresponding ports 308. Accordingly, the flow of polishing liquid to different areas on the conditioning surface 302 of the conditioning element 300 may be controlled. For example, it may be desirable to have a higher flow of polishing liquid discharged nearer the center of the conditioning element 300 and a lower flow of polishing liquid discharged nearer the outer edge 304.

The illustrated conditioning element 300 also includes a rib 408 formed in, or coupled with, a second surface that is a mounting surface 410 of the conditioning element 300. The rib 408 may be formed to engage with the groove 250 in the upper surface 246 of the mounting plate 212 (FIG. 2). The conditioning element 300 may be detachably coupled with the mounting plate 212, as previously discussed, so that the mounting surface 410 is placed in contact with the upper surface 246 of the mounting plate 212 (FIG. 2).

Referring again to FIG. 2, the illustrated polishing liquid supply line 204 includes a rotary union 260, a rotating tube 262, a first flange 264, a second flange 266, a gimbal coupler 268, a first flange keeper 270, a second flange keeper 272 and a nozzle 274. In other examples, other hardware configurations may provide similar functionality. The rotary union 260 may be any form of fitting capable of rotatably coupling a polishing liquid source (not shown) to the pad conditioning head 140. The polishing liquid source may be any mechanism(s) or device(s) capable of providing one or more pressurized polishing liquids.

The rotary union 260 includes a first non-rotatable section 280 and a second rotatable section 282. The non-rotatable section 280 is configured to accept a hose, tube or some other liquid conveyance device from a source of polishing liquid, and provide a passageway for the polishing liquid to the rotating section 282. The rotating section 282 is configured to be fixedly coupled with the rotating tube 262 and provide a flow path for the polishing liquid to the rotating tube 262. One end of the rotating tube 262 is fixedly coupled with the rotatable section 282 of the rotary union 260 with a liquid tight connection by gluing, welding, friction fit or any other coupling mechanism.

The rotating tube 262 is disposed within the rotatable spindle 214. Accordingly, as the spindle 214 rotates, the rotating tube 262 and the rotatable section 282 of the rotary union 260 all rotate together. The non-rotatable section 280 of the rotary union 260 may remain stationary. The rotating tube 262 may be any form of duct and/or passageway configured to allow a flow of liquid therethrough. One end of the first flange 264 may be fixedly coupled with the end of the rotating tube 262 opposite the rotating section 282 by welding, gluing, friction fit, and/or any other form of liquid tight connection.

The first flange keeper 270 may be coupled with the first flange 264 and the spindle 214 to maintain the relative position of the first flange 264. The end of the first flange 264 opposite the rotating tube 262 may be coupled with the gimbal coupler 268. In addition, one end of the second flange 266 may be coupled with the gimbal coupler 268. The gimbal coupler 268 may be a non-rigid duct that provides a flexible liquid tight passageway between the first and second flanges 264 and 266. As the mounting plate 212 and the conditioning element 300 gimbal, the gimbal coupler 268 may flex to eliminate strain between the first and second flanges 264 and 266.

The second flange keeper 272 may be coupled with the second flange 266 and the mounting plate 212 to maintain the relative position of the second flange 266 in the polishing liquid supply aperture 248. The end of the second flange 266 opposite the gimbal coupler 268 may form the nozzle 274. The nozzle 274 may be any mechanism(s) or device(s) capable of forming a liquid tight connection with the inlet 406 (FIG. 4). The liquid tight connection may be formed with a threaded connection, a friction fit, a snap fit, glue, welding or any other coupling mechanism. Polishing liquid flowing through the polishing liquid supply line 204 may flow through the nozzle 274 into the inlet 406 (FIG. 4).

Referring again to FIG. 1, the polishing liquid may be pumped or otherwise provided under pressure to the polishing liquid supply line 204 (FIG. 2). The flow rate of the polishing liquid may be controlled with flow control equipment, such as a flow meter and a control valve (not shown). When more than one polishing liquid supply line 204 (FIG. 2) is used, the flow rate in each of the polishing liquid supply lines 204 may be individually controlled with a separate control valve and a flow meter. As previously discussed, the flow rate of the polishing liquid may be dynamically varied based on the position of the pad conditioning head 140 on the polishing pad 116. For example, in areas of the polishing pad 116 that experience higher usage, the flow of polishing liquid may be higher. For example, the flow rate may be highest near the middle of the polishing pad 116 and be dynamically reduced as the pad conditioning head 140 gets closer to either of the first and second edges 146 and 148.

Control of the flow rate of the polishing liquid may also be based on process parameters associated with planarization of the semiconductor wafer 114. For example, a temperature sensor may monitor the temperature of the semiconductor wafer 114 during the polishing operation. As the temperature rises, additional polishing liquid may be discharged, and as the temperature falls, the flow of polishing liquid may be lessened. In other examples, other process parameters, such as the magnitude of down force applied to the semiconductor wafer 114, the amount of downforce applied to the pad conditioning head 140, the speed of the polishing pad and/or any other process parameter may be used to control the flow rate of the polishing liquid being discharged from the pad conditioning head 140 during the conditioning operation. In addition, a combination of the position of the pad conditioning head 140 and one or more process parameters may be used to control the flow rate.

During a conditioning operation, the polishing liquid may be discharged from the ports 308 to flow out onto the surface 302 of the conditioning element 300 and onto the polishing pad 116 (FIG. 1) as the surface of the polishing pad 116 is conditioned. The polishing liquid may be discharged in a controlled manner to be between the conditioning element 300 and the area of the polishing pad 116 that is being conditioned. Accordingly, the polishing liquid may be worked into the features in/on the polishing pad 116 that are created and/or enhanced during the conditioning operation. In addition, the polishing liquid may be forced into the pores of a porous polishing pad 116 (FIG. 1). As a result, the amount of polishing liquid that is embedded in the polishing pad may be maximized. Since the polishing liquid has been worked into the polishing pad 116, the polishing liquid is less likely to be thrown off or pushed aside by the semiconductor wafer 114 being polished. Thus, the volume of polishing liquid between the semiconductor wafer 114 and the polishing pad 116 is maximized. As a result of the maximized volume of polishing liquid, delamination and/or other detrimental effects associated with insufficient amounts of polishing liquid may be avoided.

The pad conditioning head 142 may also condition and apply polishing liquid in determined local areas of the polishing pad 116 instead of spraying polishing liquid over larger areas of the polishing pad 116 where it may dry or otherwise not be used. Further, the pad conditioning head 140 may dynamically vary the flow rate of the polishing liquid to compensate for areas of the polishing pad 116 with varying amounts of polishing liquid already present.

As should be recognized, the rotating and non-rotating sections 280 and 282 of the rotary union 260 are not necessary when the pad conditioning head 140 does not rotate. In addition, the gimbal coupler 268 may be enlarged and/or modified appropriately when the mounting plate 212 and the conditioning element 300 are capable of reciprocating movement during conditioning of the polishing pad 116 (FIG. 1).

Figure 5:
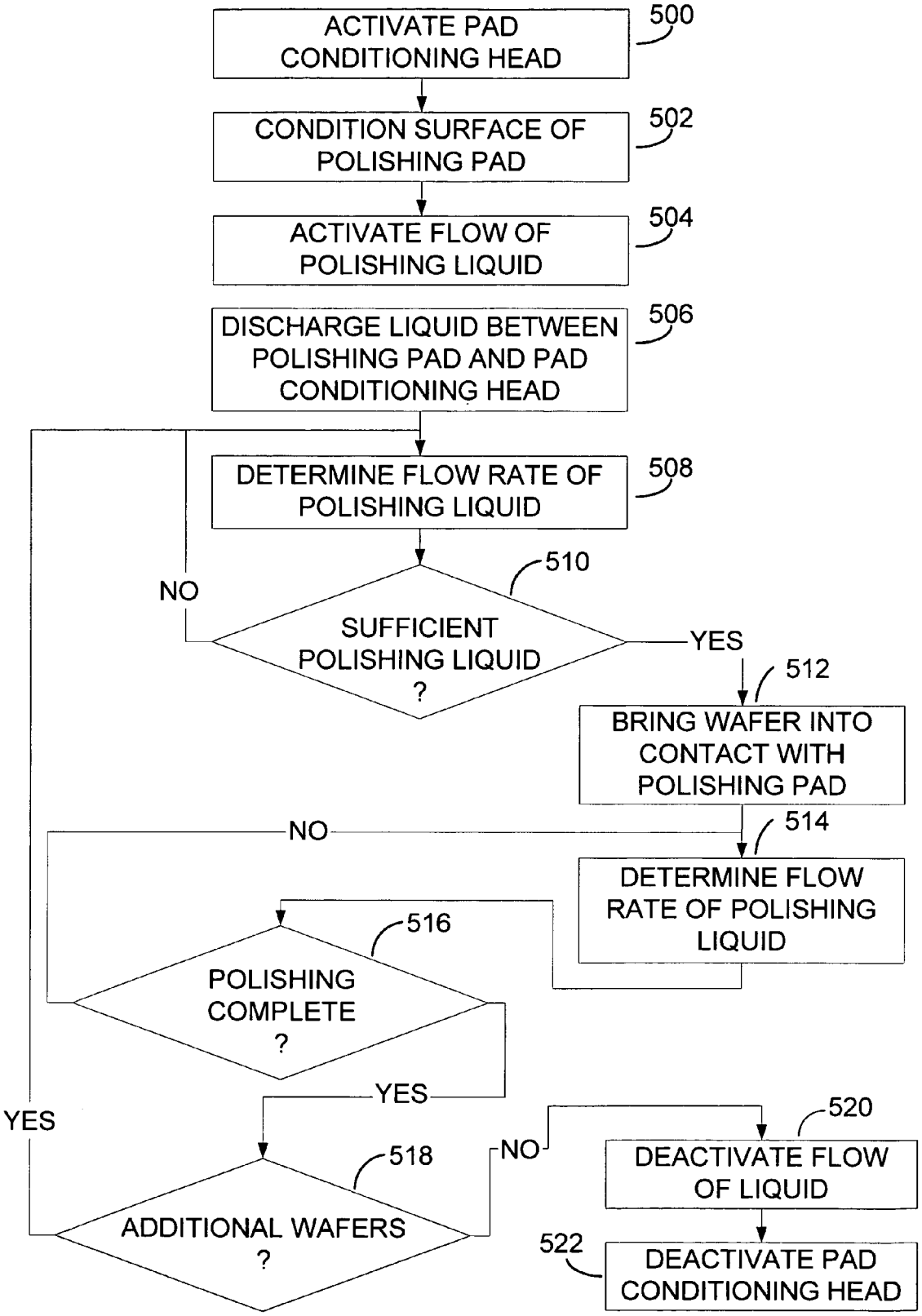
FIG. 5 is an example operational flow diagram for the chemical planarization machine illustrated in FIG. 1.

FIG. 5 is a flow diagram illustrating example operation of the pad conditioning system 100 with reference to FIGS. 1–4 during lineal polishing of a semiconductor wafer 114. The operation begins at block 500 when the pad conditioning head 140 is activated and moved into contact with the rotating polishing pad 116. At block 502, the pad conditioning head 140 is activated to rotate and down force is applied by the positioning unit 142 to roughen the surface of the polishing pad 116. The flow of polishing liquid is activated to flow through the polishing liquid supply line 204 at block 504.

At block 506, the polishing liquid is discharged from the ports 308 to be between the polishing pad 116 and the conditioning element 300. The position of the pad conditioning head 140 and/or process parameters are used to determine a corresponding flow rate at block 508. The flow rate of polishing liquid is sufficient to embed the conditioned portion of the polishing pad 116 with polishing fluid. At block 510, it is determined if there is sufficient polishing fluid worked into the polishing pad 116 to start planarizing a semiconductor wafer 114. If there is not yet sufficient polishing liquid, the operation returns to block 508. If there is sufficient polishing liquid in the polishing pad 116, a wafer 114 mounted on the wafer carrier 112 is brought into contact with the rotating polishing pad 116 at block 512.

At block 514, the position of the pad conditioning head 140 and/or process parameters are used to determine a corresponding flow rate of the polishing liquid. It is determined at block 516 if polishing of the semiconductor wafer 114 is complete. If polishing of the semiconductor wafer 114 is not complete, the operation returns to block 514. If polishing of the semiconductor wafer 114 is complete, it is determined from the process parameters if another semiconductor wafer 114 is set to be polished at block 518. If another semiconductor wafer 114 is ready to be polished, the operation returns to block 508. If polishing is complete, the flow of polishing liquid is deactivated at block 520, and the pad conditioning head 140 is deactivated and removed from the polishing pad 116 at block 522.

It is therefore intended that the foregoing detailed description be regarded as illustrative rather than limiting, and that it be understood that it is the following claims, including all equivalents, that are intended to define the spirit and scope of this invention.

What is claimed is:

1. A pad conditioning system for conditioning a polishing pad in conjunction with polishing a workpiece, the pad conditioning system comprising:

a pad conditioning head configured to condition a polishing pad;

a polishing liquid supply port included in the pad conditioning head, wherein the polishing liquid supply port is configured to selectively discharge a polishing liquid; and a positioning unit coupled with the pad conditioning head, wherein the positioning unit is configured to move the pad conditioning head into contact with the polishing pad to condition the polishing pad, and to simultaneously work the polishing liquid discharged from the polishing liquid supply port into the conditioned polishing pad, wherein a flow rate of the polishing liquid is selectively variable as a function of a position of the pad conditioning head on the polishing pad.

2. The pad conditioning system of claim 1, wherein the polishing liquid supply port is disposed on the pad conditioning head so that the polishing liquid is to be discharged between the pad conditioning head and the polishing pad.

3. The pad conditioning system of claim 1, wherein the pad conditioning head includes a substantially flat surface configured to contact the polishing pad, the polishing liquid supply port formed in the substantially flat surface.

4. The pad conditioning system of claim 1, wherein the positioning unit is configured to move the pad conditioning head into contact with the polishing pad with sufficient contact pressure to roughen the polishing pad, the polishing liquid worked into features in the polishing pad that are one of created and embellished when the polishing pad is roughened.

5. The pad conditioning system of claim 1, wherein the polishing liquid is a slurry of liquid that includes suspended abrasive particles.

6. The pad conditioning system of claim 1, wherein the positioning unit is configured to maintain contact between the pad conditioning head and the polishing pad and selectively move the pad conditioning bead in a predetermined pattern around on the surface of the polishing pad.

7. The pad conditioning system of claim 1, wherein a flow rate of the polishing liquid is selectively variable as a function of a process parameter associated with polishing of a workpiece and the position of the pad conditioning head on the polishing pad.

8. The pad conditioning system of claim 1, wherein the polishing liquid is worked into the polishing pad so that the polishing liquid is available to assist in polishing a workpiece brought into contact with the conditioned polishing pad.

9. A pad conditioning system for conditioning a polishing pad in conjunction with polishing of a workpiece, the pad conditioning system comprising:

a conditioning element having a conditioning surface, wherein the conditioning surface is configured to be pressed into a polishing pad to condition the polishing pad; and a passageway formed in the conditioning element, the passageway having an inlet and an outlet, wherein the outlet is formed in the conditioning surface so that a polishing liquid to be supplied to the inlet during conditioning of the polishing pad is discharged between the conditioning surface and the polishing pad, wherein a flow rate of the polishing liquid is dynamically varied as a function of a process parameter associated with polishing a workpiece.

10. The pad conditioning system of claim 9, further comprising a polishing liquid supply line configured to supply polishing liquid to the inlet of the passageway.

11. The pad conditioning system of claim 9, wherein the outlet is a plurality of outlets and the passageway comprises a supply manifold and a plurality of discharge passages, wherein each of the discharge passages form, one of the outlets.

12. The pad conditioning system of claim 9, wherein the inlet is on a mounting surface of the conditioning element that is opposite the conditioning surface.

13. The pad conditioning system of claim 9, wherein the conditioning element comprises a disc having one flat surface that is the conditioning surface and another flat surface that is a mounting surface for mounting the disc to a pad conditioning head.

14. The pad conditioning system of claim 9, further comprising a pad conditioning bead coupled with the conditioning element, and a positioning unit coupled with the pad conditioning head, wherein the pad conditioning head is configured to be placed in contact with the polishing pad by the positioning unit so that the conditioning element is pressed into the polishing pad.

15. The pad conditioning system of claim 14, wherein the positioning unit is configured to move the pad conditioning head in a determined pattern on the surface of the polishing pad.

16. The pad conditioning system of claim 9, wherein the process parameter is a temperature of the workpiece.

17. The pad conditioning system of claim 9, wherein the discharged polishing liquid is useable to polish a workpiece brought into contact with the conditioned polishing pad.

18. A pad conditioning system for conditioning a polishing pad in conjunction with polishing of a workpiece, the pad conditioning system comprising:

a housing;

a conditioning element detachably coupled with the housing, the conditioning element formed with a port disposed on a surface of the conditioning element;

a passageway formed in the conditioning element with an inlet and an outlet, wherein the port is the outlet of the passageway; and a polishing liquid supply line configured to supply polishing liquid to the inlet of the passageway at a flow rate that is variable based on a process parameter associated with polishing a workpiece, wherein the surface of the conditioning element is configured to roughen a polishing pad and work the polishing liquid discharged from the outlet into the roughened polishing pad.

19. The pad conditioning system of claim 18, wherein the housing comprises a mounting plate, the conditioning element rigidly mounted on the mounting plate so that the mounting plate and the conditioning element are configured to gimbal together.

20. The pad conditioning system of claim 19, further comprising a gimbal coupler included in the polishing liquid supply line, wherein the gimbal coupler is flexible to enable the mounting plate and the conditioning element to gimbal without one of stress and kinking of the liquid supply line.

21. The pad conditioning system of claim 18, further comprising a positioning unit, wherein the positioning unit is configured to maneuver the housing to press the conditioning element into the polishing pad, the positioning unit further configured to maneuver the housing to move the conditioning element in a determined pattern around a surface of the polishing pad to roughen the surface of the polishing pad and to embed polishing liquid in the roughened surface.

22. The pad conditioning system of claim 18, wherein the housing and the conditioning element are configured to rotate while being pressed into the polishing pad, and the polishing liquid supply line includes a rotary union so that a portion of the polishing liquid supply line is rotatable with the conditioning element.

23. The pad conditioning system of claim 18, wherein the port is a plurality of ports that are arranged on the surface of the conditioning element, and each of the ports may selectively discharge polishing liquid.

24. The pad conditioning system of claim 18, wherein the polishing pad comprises a porous polishing pad and the polishing liquid is forced into a plurality of pores in the porous polishing pad by the conditioning element.

25. The pad conditioning system of claim 18, wherein the polishing liquid is forced into at least one of micro channels, inequalities, unevenness, ridges, valleys projections, grooves and channels formed in the polishing pad by the conditioning element.

26. A method of conditioning a polishing pad in conjunction with polishing of a workpiece, the method comprising:

pressing a conditioning surface of a pad conditioning head into a polishing pad to condition the polishing pad, discharging a polishing liquid from the conditioning surface so that the polishing liquid is between the conditioning surface and the polishing pad;

dynamically varying the flow rate of the polishing liquid being discharged as a function of an operational parameter associated with polishing a workpiece; and working the polishing liquid into the polishing pad with the conditioning surface at the same time the polishing pad is being conditioned.

27. The method of claim 26, wherein pressing a conditioning surface comprises gimbaling a portion of the pad conditioner head so that the conditioning surface remains substantially parallel with the polishing pad.

28. The method of claim 26, wherein pressing a conditioning surface comprises repositioning the pad conditioning head in various locations on the surface of the polishing pad.

29. The method of claim 26, wherein discharging a polishing liquid comprises selectively discharging polishing liquid between the conditioning surface and polishing pad in the area of the polishing pad being conditioned.

30. The method of claim 26, wherein discharging a polishing liquid comprises dynamically varying the flow rate of the polishing liquid being discharged as a function of the position of the pad conditioning head on the polishing pad.

31. The method of claim 26, wherein dynamically varying the flow rate of the polishing liquid being discharged comprises dynamically varying the flow rate of the polishing liquid as a function of the position of the pad conditioning head on the polishing pad and the operational parameter.

32. The method of claim 26, wherein working the polishing liquid into the polishing pad comprises massaging the polishing liquid into features that are one of formed and embellished during conditioning.

33. The method of claim 26, wherein working the polishing liquid into the polishing pad comprises forcing the polishing liquid into features of the polishing pad, wherein the features include grooves and channels.

34. The method of claim 26, wherein working the polishing liquid into the polishing pad comprises massaging the polishing liquid into the pores of the polishing pad.

35. The method of claim 26, further comprising polishing a workpiece with the conditioned polishing pad that has the polishing liquid worked therein.

* * * * *